US005281386A

United States Patent [19]

Weinert

[11] Patent Number: 5,281,386

[45] Date of Patent: Jan. 25, 1994

[54] METHOD FOR SHAPING THE CENTER HOLE OF A CORELESS PAPER ROLL

[75] Inventor: Lawrence E. Weinert, Antioch, Calif.

[73] Assignee: James River Paper Company, Inc., Richmond, Va.

[21] Appl. No.: 935,915

[22] Filed: Aug. 27, 1992

[51] Int. Cl.[5] ..... B65H 17/00

[52] U.S. Cl. ..... 264/512; 264/292; 264/322; 264/324; 264/570; 264/293; 264/303

[58] Field of Search ..... 264/322, 324, 510, 512, 264/570, 573, 292; 493/960, 293, 303; 162/205, 206

[56] References Cited

U.S. PATENT DOCUMENTS

| | | | |
|---|---|---|---|
| 1,408,126 | 2/1922 | Mumm . | |
| 1,459,596 | 6/1923 | Mayo . | |
| 2,557,017 | 6/1951 | Stahl | 493/293 |
| 2,697,563 | 12/1954 | Miller et al. | 242/72 |
| 3,106,362 | 10/1963 | Sukala, Jr. | 242/68 |
| 3,355,121 | 8/1967 | Wright et al. | 242/68.2 |
| 3,519,216 | 7/1970 | Rienzi et al. | 242/68.2 |
| 3,632,732 | 1/1972 | Osterhagen et al. | 264/322 |
| 3,704,837 | 12/1972 | Heinz et al. | 242/68.2 |
| 3,853,279 | 12/1974 | Gerstein | 242/56.2 |
| 3,856,226 | 12/1974 | Dowd, Jr. | 242/56 R |
| 4,083,918 | 4/1978 | Ronden et al. | 264/322 |
| 4,160,530 | 7/1979 | Plach | 242/68.2 |
| 4,487,378 | 12/1984 | Kobayashi | 242/68 |

FOREIGN PATENT DOCUMENTS

| | | | |
|---|---|---|---|
| 0048975 | 4/1982 | European Pat. Off. . | |
| 803016 | 2/1951 | Fed. Rep. of Germany | 264/324 |
| 544345 | 4/1942 | United Kingdom | 264/324 |

*Primary Examine,* —James Lowe

*Attorney, Agent, or Firm*—Thomas R. Lampe

[57] ABSTRACT

A method and apparatus for forming a coreless paper roll having a specifically shaped central aperture. A probe is inserted into the central aperture of the roll after the winding mandrel has been removed from the roll to change the configuration of the central aperture over at least a portion of the length thereof.

4 Claims, 1 Drawing Sheet

METHOD FOR SHAPING THE CENTER HOLE OF A CORELESS PAPER ROLL

TECHNICAL FIELD

This invention relates to the manufacture of coreless paper roll products. More particularly, the invention is concerned with a method of forming a coreless paper roll having a central aperture with a predetermined cross-sectional configuration over at least a portion of the length thereof. In addition, the invention encompasses apparatus for reforming the shape of a central aperture of a wound coreless paper roll product defined by the innermost convolution of the roll.

BACKGROUND ART

It is well known to form coreless paper roll products, such as rolls of toilet tissue, on mandrels having cross-sectional configurations of predetermined types. For example, U.S. Pat. No. 3,853,279, issued Dec. 10, 1974, and U.S. Pat. No. 3,856,226, issued Dec. 24, 1974, both disclosed methods and apparatus wherein coreless rolls are formed by winding webs of tissue or other paper types directly upon round winding mandrels.

U.S. Pat. No. 4,487,378, issued Dec. 11, 1984, discloses a coreless toilet paper roll having a center hole which is formed by winding toilet paper on a winding shaft having a polygonal or gear-shaped section and then extracting the polygonal or gear-shaped winding shaft from the roll.

Of course, when winding mandrels are removed from wound tissue rolls or the like, a central aperture or hole is formed where the mandrel was located. However, the shape or cross-section of the central aperture may not always be suitable for the intended use of the roll product, as for example, when the hole is disturbed by sawing the cant into individual rolls.

The present invention provides a method and a means whereby the shape of the central aperture may be modified over at least a portion of the length thereof to better accommodate the paper roll to its intended use. For example, the central aperture or hole may be modified at only one side of the roll to make the roll right or left handed for correct installation in a dispenser or suitable for use with certain types of dispensers.

When carrying out the teachings of the present invention, a probe insertable into the central aperture is utilized to modify the shape of inner wound layers of the coreless roll. A search of the prior art located a number of patents directed to plugs, bushings, mandrels and the like which are inserted into the ends of rolls for various purposes, primarily improved support, but do not pertain to modifying the shape of the roll product central aperture upon removal of the mandrel, plug or other device. The patents located in the search are as follows: U.S. Pat. No. 3,106,362, issued Oct. 8, 1963, U.S. Pat. No. 3,519,216, issued Jul. 7, 1970, U.S. Pat. No. 1,459,596, issued Jun. 19, 1923, U.S. Pat. No. 1,408,126, issued Feb. 28, 1922, U.S. Pat. No. 4,160,530, issued Jul. 10, 1979, U.S. Pat. No. 3,704,837, issued Dec. 5, 1972, U.S. Pat. No. 3,355,121, issued Nov. 28, 1967, U.S. Pat. No. 2,697,563, issued Dec. 21, 1954, and European Patent Application Publication No. 48,975, published Apr. 7, 1982.

DISCLOSURE OF INVENTION

The present invention relates to a system of forming a coreless paper roll having a central aperture with a predetermined cross-sectional configuration over at least a portion of the length thereof. The central aperture is defined by the innermost paper convolution of the roll and the roll has opposed first and second sides.

According to the method of the present invention, a paper web is wound directly on a mandrel to a form a coreless paper roll. The coreless paper roll is then removed from the mandrel whereby the coreless paper roll defines a central aperture extending between the roll first and second sides and having a first cross-sectional configuration.

A probe is inserted into the central aperture from a predetermined side of the coreless paper roll. The probe has an outer peripheral surface with a second cross-sectional configuration differing from the first cross-sectional configuration.

During the inserting step, the shape of the inner wound layers of the coreless paper roll including the inner paper convolution are modified.

After the step of modifying the shape of the inner wound layers, the probe and the coreless paper roll are separated whereby the central aperture has the predetermined cross-sectional configuration at the predetermined coreless paper roll side.

The present invention further encompasses apparatus for reforming the shape of a central aperture of a coreless paper roll defined by the innermost convolution of the roll. The apparatus comprises a probe for insertion into the central aperture and for modifying the shape of the inner wound layers of the coreless paper roll.

The probe includes a first probe segment having an outer peripheral surface exceeding in magnitude the length of the innermost convolution and having a cross-sectional configuration differing from the cross-sectional configuration of the central aperture.

The probe additionally includes a second probe segment connected to the first probe segment. The second probe segment has a tapered outer surface converging to a point for facilitating insertion of the probe into the coreless paper roll central aperture.

The probe defines a fluid-flow passageway communicating with the exterior of the probe for injecting pressurized fluid into the coreless paper roll central aperture after the probe has been inserted therein.

Other features, advantages, and objects of the present invention will become apparent with reference to the following description and accompanying drawings.

BEST MODE FOR CARRYING OUT THE INVENTION

Figure 1:
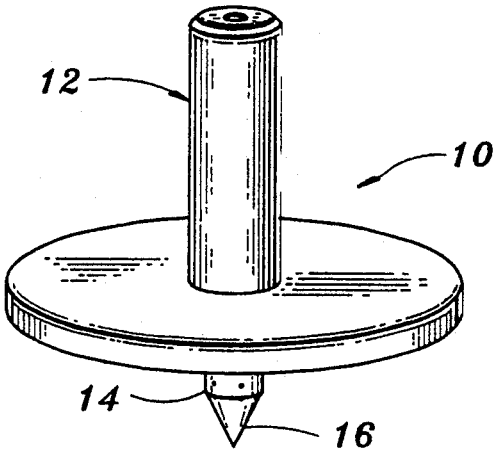
FIG. 1 is a frontal, perspective view of a probe constructed in accordance with the teachings of the present invention.
Figure 2:
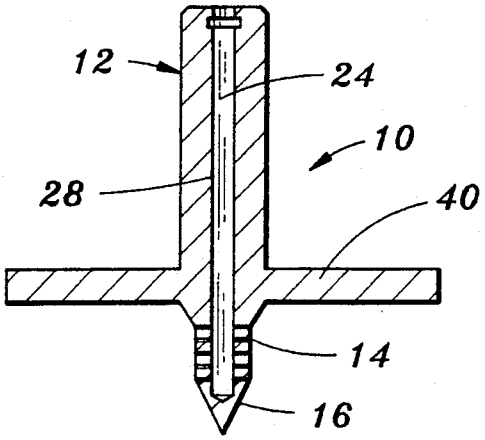
FIG. 2 is a frontal, cross-sectional view of the probe.
Figure 3:
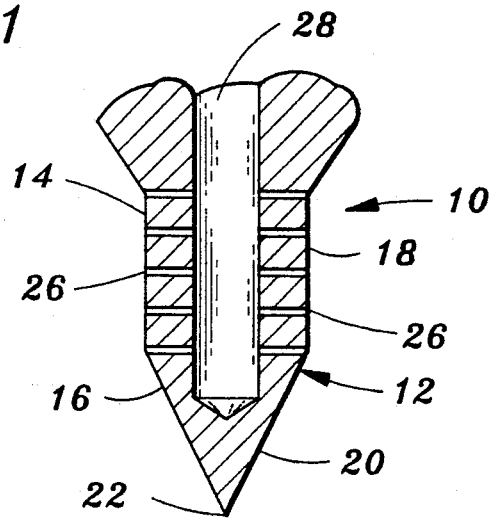
FIG. 3 is an enlarged, frontal, cross-sectional view of first and second probe segments.

Referring now to FIGS. 1-3 of the drawings, apparatus constructed in accordance with the teachings of the present invention is illustrated. The apparatus 10 includes a probe 12 including a first probe segment 14 and a second probe segment 16 integrally connected thereto. In the arrangement illustrated, first probe segment 14 has an outer peripheral surface 18 which has a circular cross section. The second probe segment 16 has a tapered outer surface 20 which converges to a point 22.

Probe 12 defines a fluid-flow passageway 24 which includes a plurality of openings 26 formed in the outer peripheral surface of the first probe segment and extending inwardly to communicate with the main fluid-flow passageway portion 28 which leads to an opening formed at the end of the probe 12 at a location remote from second probe segment 16.

Figure 4:
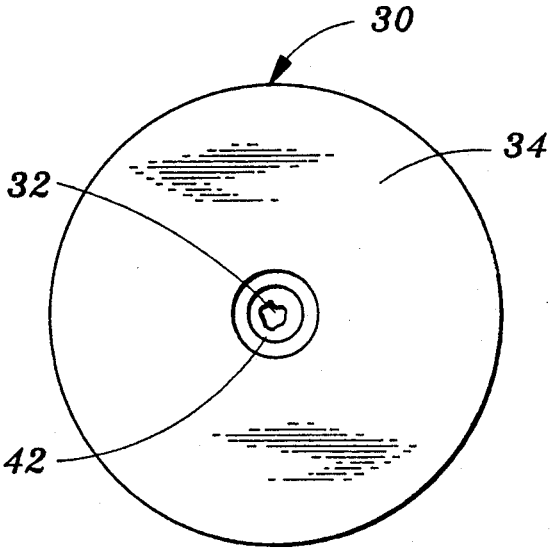
FIG. 4 is a side view of a coreless toilet tissue roll formed in accordance with the teachings of the present invention.
Figure 5:
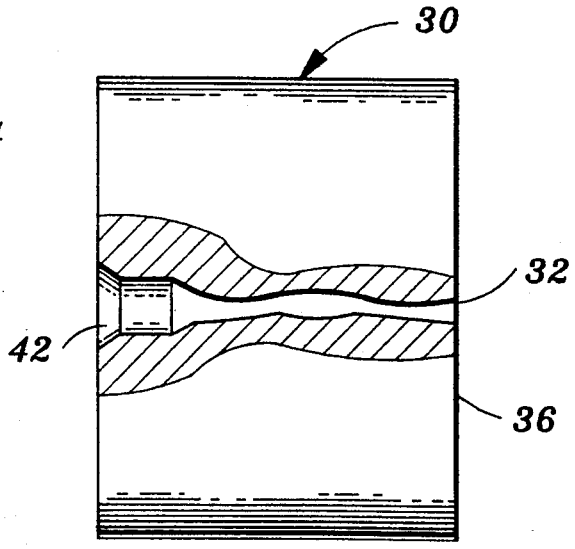
FIG. 5 is frontal view of the roll with a portion thereof broken away to show details of the central aperture.

Referring now to FIGS. 4 and 5, a coreless roll of toilet tissue 30 which has been formed by utilizing the teachings of the present invention is illustrated. As is conventional, and well known in the prior art, the initial step in the formation of roll 30 comprises winding a web of tissue directly on a mandrel. The roll is then removed from the mandrel whereby the coreless paper roll defines a central aperture 32 defined by the innermost convolution of the roll. The roll has opposed first and second sides 34, 36 and the aperture 32 extends completely through the wall between the sides.

FIGS. 4 and 5 show the roll 30 in the configuration it assumes after it has been completely formed in accordance with the teachings of the present invention, that is, after it has been treated by utilization of the probe 12 in a manner which will be described below. However, it will be appreciated that a roll after removal from its forming mandrel and prior to treatment by the probe 12, will have a central aperture having a first cross-sectional configuration. For example, with specific reference to FIG. 5, the central aperture 32 of the roll 30 at the side 36 of the roll has a cross-sectional configuration of the type which might result after removal of the forming mandrel. Immediately after removal of the roll from the mandrel, of course, the resultant central aperture cross-sectional configuration produced thereby will extend completely from side 34 to side 36. In FIG. 5 the first cross-sectional configuration which results from removal of the winding mandrel has a somewhat wavy configuration defined by the innermost tissue convolution. This particular shape is merely representative of the type of central aperture cross-sectional configuration which may occur upon removal from a winding mandrel.

In any event, the objective of the present invention is to modify at least a portion of the length of the central aperture after removal of the winding mandrel. This is accomplished by inserting probe 12 into the central aperture from a predetermined side of the roll, in the present case from side 34 thereof. The point 22 of the probe facilitates this action by providing general alignment between the probe and the central aperture. The probe and the roll are then urged together so that the innermost paper convolution is slid over tapered outer surface 22. This results in modification of the shape of the inner wound layers of the coreless paper roll. The probe and roll are urged together until side 34 of the roll is engaged by a plate or stop 40 which projects outwardly from the first probe segment 14.

It will be appreciated that during the afore-described inserting step, the shape of the inner wound layers of the coreless paper roll including the innermost paper convolution are modified so that they assume the shape of that portion of the probe engaged thereby.

The probe and the roll are then separated whereby the central aperture has the predetermined cross-sectional configuration desired. This may or may not correspond exactly with the shape of the probe, however, likelihood that this will in fact be the situation is enhanced if a liquid such as water or a water-adhesive combination is injected into the central aperture when the probe is positioned therein. Such injection will take place through fluid-flow passageway 24 which is in communication with a suitable source of such liquid (not shown). Reference numeral 42 identifies that portion of the central aperture 32 which has been modified by insertion and removal of the probe. The aperture portion 42 may be shaped for any desired purpose. For example, the shape may render the roll suitable for use with a key system employed in a dispenser which will enable only certain types of rolls to be utilized therewith. Also, the shaping of aperture portion 42 will help an attendant orient the roll correctly within a dispenser cabinet if the dispenser cabinet has a single mounting post or arm corresponding to the shape of portion 42. The principles of the present invention can also be employed to reshape the entire length of the central aperture 32, if desired.

I claim:

1. A method of forming a coreless paper roll including a central aperture defined by the innermost paper convolution of said roll, said roll having opposed first and second sides and said central aperture having a predetermined cross-sectional configuration over at least a portion of the length thereof, said method comprising the steps of:

winding a paper web directly on a mandrel to form a coreless paper roll comprised of a plurality of convolutions of said paper web;

removing the coreless paper roll from said mandrel whereby said coreless paper roll has a central aperture extending between said first and second sides and having a first cross-sectional configuration, said central aperture being defined by the innermost paper convolution and said innermost paper convolution having a given length;

inserting a probe into said central aperture from a predetermined side of the coreless paper roll, said probe including a segment having an outer peripheral surface with a second cross-sectional configuration differing from said first cross-sectional configuration and an outer peripheral surface length exceeding the length of said innermost convolution;

during said inserting step, modifying the shape of inner wound layers of said coreless paper roll including said inner paper convolution, said modifying step including stretching at least some of said innermost paper convolution; and after the step of modifying the shape of the inner wound layers, separating said probe and said coreless paper roll whereby said central aperture has said predetermined cross-sectional configuration at said predetermined coreless paper roll side, said probe having a tapered outer surface converging to a point from said segment, and said inserting step including initially engaging said predestined side of the coreless paper roll with said point at the location of said central aperture, said step of modifying the shape of the inner would layers of said coreless paper roll being accomplished gradually by sliding said innermost paper convolution over said tapered surface.

2. The method according to claim 1 wherein said probe is inserted only part way into said central aperture whereby the shape of said inner would layers is modified only over a portion of the length of said central aperture.

3. A method of forming a coreless paper roll including a central aperture defined by the innermost paper convolution of said roll, said roll having opposed first and second sides and said central aperture having a predetermined cross-sectional configuration over at least a portion of the length thereof, said method comprising the steps of:

winding a paper web directly on a mandrel to form a coreless paper roll comprised of a plurality of convolutions of said paper web;

removing the coreless paper roll from said mandrel whereby said coreless paper roll has a central aperture extending between said first and second sides and having a first cross-sectional configuration, said central aperture being defined by the innermost paper convolution and said innermost paper convolution having a given length;

inserting a probe into said central aperture from a predetermined side of the coreless paper roll, said probe including a segment having an outer peripheral surface with a second cross-sectional configuration differing from said first cross-sectional configuration and an outer peripheral surface length exceeding the length of said innermost convolution;

during said inserting step, modifying the shape of inner would layers of said coreless paper roll including said innermost paper convolution;

inserting liquid into said central aperture after said probe has been inserted into said central aperture to moisten the inner wound layers of said coreless paper roll; and after the step of modifying the shape of the inner wound layers, separating said probe and said coreless paper roll whereby said central aperture has said predetermined cross-sectional configuration at said predetermined coreless paper roll side.

4. The method according to claim 3 wherein said liquid injecting step includes directing pressurized fluid through a fluid-flow passageway defined by said probe and into engagement with the inner convolution of said roll about the outer periphery of said probe.

* * * * *